US006223516B1

(12) United States Patent
Falcon et al.

(10) Patent No.: US 6,223,516 B1
(45) Date of Patent: May 1, 2001

(54) FACETING HOLLOW LINK CHAIN WITH FINGER

(75) Inventors: Carlos Zenon Rubio Falcon; Angel Ramon Solanilla, both of Lima (PE)

(73) Assignee: D&W Jewelry, Inc., New York, NY (US)

( * ) Notice: Subject to any disclaimer, the term of this patent is extended or adjusted under 35 U.S.C. 154(b) by 0 days.

(21) Appl. No.: 09/497,411

(22) Filed: Feb. 3, 2000

(51) Int. Cl.[7] ..... B21L 15/00
(52) U.S. Cl. ..... 59/35.1; 59/80
(58) Field of Search ..... 59/35.1, 80

(56) References Cited

U.S. PATENT DOCUMENTS

| | | | | |
|---|---|---|---|---|
| 5,125,225 | | 6/1992 | Strobel | 59/80 |
| 5,129,220 | | 7/1992 | Strobel | 59/80 |
| 5,285,625 | | 2/1994 | Ofrat et al. | 59/80 |
| 5,353,584 | | 10/1994 | Strobel et al. | 59/80 |
| 5,408,820 | * | 4/1995 | Strobel et al. | 59/80 |
| 5,437,149 | * | 8/1995 | Strobel | 59/80 |
| 5,471,830 | * | 12/1995 | Gonzales | 59/80 |
| 5,487,264 | * | 1/1996 | Strobel | 59/80 |
| 5,526,639 | * | 6/1996 | Gonzales | 59/35.1 |
| 5,535,583 | | 7/1996 | Holzer et al. | 59/80 |
| 5,581,993 | * | 12/1996 | Strobel | 59/35.1 |
| 5,605,038 | * | 2/1997 | Rozenwasser | 59/35.1 |
| 5,737,910 | | 4/1998 | Rozenwasser | 59/80 |
| 5,797,258 | * | 8/1998 | Strobel et al. | 59/35.1 |
| 5,966,922 | | 10/1999 | Cossio | 59/80 |

* cited by examiner

*Primary Examiner*—David Jones
(74) *Attorney, Agent, or Firm*—Helfgott & Karas, P.C.

(57) ABSTRACT

A method of diamond cutting or faceting hollow link jewelry chain by arranging a chain on an ice lathe support, completely freezing the chain on such support and moving a blunt instrument across such chain to produce flattened links. The pressure of the blunt instrument against the frozen chain simultaneously scrapes off the ice and flattens the links, thereby avoiding the requirement that the portion of the links that are to be faceted be initially unfrozen. The blunt instrument may be a so-called "finger of steel", which can be sharp, pointed, rounded, arcuate, smooth or the like. A variety of faceting formations can be realized depending on the movement of the blunt instrument across the outer surface of such chain.

20 Claims, 3 Drawing Sheets

FACETING HOLLOW LINK CHAIN WITH FINGER

FIELD OF THE INVENTION

The invention relates generally to the faceting of hollow link jewelry chains, and more particularly to the deformation of the outer surface of a hollow link jewelry chain while such chain is completely frozen and arranged on a support.

BACKGROUND OF THE INVENTION

Diamond cutting solid link chain is a well-known art, and is usually accomplished by shearing off a section of the exterior surface of the exposed chain links to form a facet thereon. Faceting with flattened surfaces is also a well known method of enhancing the aesthetic appeal of a jewelry chain, and several different methods have developed in the art to carry out the faceting thereof.

Faceting of hollow link jewelry chain, on the other hand, requires more specialized attention. For example, if a portion of the exterior surface of a hollow link chain was sheared off, as is normally done with solid link chain, the likely result will be a hole therethrough and not a smooth, flattened surface thereon. Jewelry chains formed by intertwining hollow chain links are particularly problematic, because the material used to form the links is usually very thin, and thus very susceptible to perforation. However, in U.S. Pat. No. 5,966,922 to Cossio, the material limitations that caused perforations in the prior art are overcome by tempering and precisely positioning the chain prior to diamond cutting.

One solution for faceting hollow link jewelry chain is disclosed in U.S. Pat. Nos. 5,129,220 and 5,353,584, both to Strobel. Strobel provided for a flattening of the links, i.e., without the removal of any surface material. He used the ice lathe method where the links were frozen, and then he applied a blunt instrument to pound the links incrementally, thereby flattening them. Once the links were flattened, it was possible to diamond cut or polish them as desired. Strobel's method only covers the incrementally pounding of links, which has been determined to not be a very commercially efficient method. Other methods that do not rely on the use of an ice lathe are also known in the art, including a method of faceting hollow link jewelry chain wherein a chain is moved continuously over pulley guides whereon the exposed chain surface is deformed without removal of chain material as taught in U.S. Pat. No. 5,535,583 to Holzer et al.

An improvement in the art of faceting hollow link jewelry chain was revealed in U.S. Pat. No. 5,605,038 to Rosenwasser, wherein it was disclosed to use a pressure roller that freely rotates to flatten links. However, the '038 patent is limited to a Garibaldi type chain. In Rosenwasser's CIP, which issued as U.S. Pat. No. 5,737,910, he broadens the initial concept by applying a pressure roller to any link, presumably including rope chain links. Additionally, throughout both the '038 and '910 patents, Rosenwasser indicates that in using the pressure roller, only the lower portion of the links should be frozen using the ice lathe method, while the upper portions to be rolled with a pressure roller should be free of ice. Rosenwasser teaches that "In the case of hollow rope chains, only the lower half of the chain is embedded in ice near the drum surface, since if one were to cover the entire chain with ice it would be difficult to form a flat indentation in the annular link, because solid ice formed inside the hollow link would resist the deformation of the link wall." (see Col. 2, lines 14–20 of the '038 patent).

Rosenwasser's method requiring that a portion of the chain be defrosted prior to flattening is currently the state of the art. Unfortunately, great care must be taken to ensure that a portion of the chain remains ice-free during the flattening or faceting process. This usually involves the controlled freezing of the chain, followed by a controlled heating, usually by a heating mantle, where the upper layer of ice surrounding the outermost portions of the chain is slowly and controllably melted away. The controlled freezing and heating of hollow link jewelry chain for purposes of flattening and/or faceting is an unwelcome manufacturing hassle, because it increases the time of manufacture and cost of production, which results in an increased cost borne by the consumer.

In an effort to reduce costs and simplify the manufacturing process, the present inventor has devised a method of continuous flattening of a hollow link jewelry chain without requiring that a portion of the chain remain ice-free. According to the method of the present invention, a hollow link chain is completely frozen on a supporting drum of an ice lathe for example. Without defrosting any portion of the chain, a blunt instrument, such as a so-called "finger of steel" is advanced across the outer surface of the chain, which simultaneously scrapes off the surface layer of ice from the chain and flattens the links that form the chain. The pressure of the instrument against the surface of the chain crushes or melts some ice formed on the inside of the hollow links, thereby overcoming the problem described by Rosenwasser above.

Once a hollow link jewelry chain is wound and frozen using the ice lathe method described above, the type of facets that can be made depend upon the ones that are desired. For example, as the drum is rotated and the blunt instrument is just moved horizontally, the result will be a flat facet along one side of the chain. The chain can then be repositioned in 90 degree increments to get four flat facets on four sides of the chain. Alternately, six sides, eight sides, etc., can be faceted. On the other hand, if the instrument is arcuate at its contact with the chain, a spiral type facet can be made as per U.S. Pat. No. 5,285,625 to Ofrat et al.

OBJECTS OF THE INVENTION

It is an object of the present invention, therefore, to provide a method of faceting hollow link chain by freezing such chain on a supporting ice lathe and flattening the exterior surface of the chain links without defrosting a portion of the chain to be faceted.

It is a further object of the present invention to provide a method of faceting hollow link chain by advancing a blunt instrument across a frozen chain to flatten the chain links.

It is a still further object of the present invention, to provide a method of faceting hollow link chain by advancing a blunt instrument across a frozen chain that simultaneously scrapes the ice from the links and flatten the links of the chain.

It is a still further object of the present invention, to provide a method of faceting hollow link chain by moving a blunt instrument across a frozen chain in a variety of ways to produce a variety of faceting configurations along such chain.

Still other objects and advantages of the invention will become clear upon review of the following detailed description in conjunction with the appended drawings.

SUMMARY OF THE INVENTION

A method of diamond cutting or faceting hollow link jewelry chain by arranging a chain on an ice lathe support, completely freezing the chain on the support and moving a blunt instrument across such chain to produce flattened links. The pressure of the blunt instrument against the frozen chain simultaneously scrapes off the ice and flattens the links, thereby avoiding the requirement that the portion of the links that are to be faceted be free of ice or unfrozen. The blunt instrument may be a so-called "finger of steel", which can be sharp, pointed, rounded, arcuate, smooth or the like. A hollow link chain can be enhanced with a variety of faceting formations, depending on the instrument and its advancement across the outer surface of such chain.

DETAILED DESCRIPTION OF THE PREFERRED EMBODIMENTS

Figure 1:
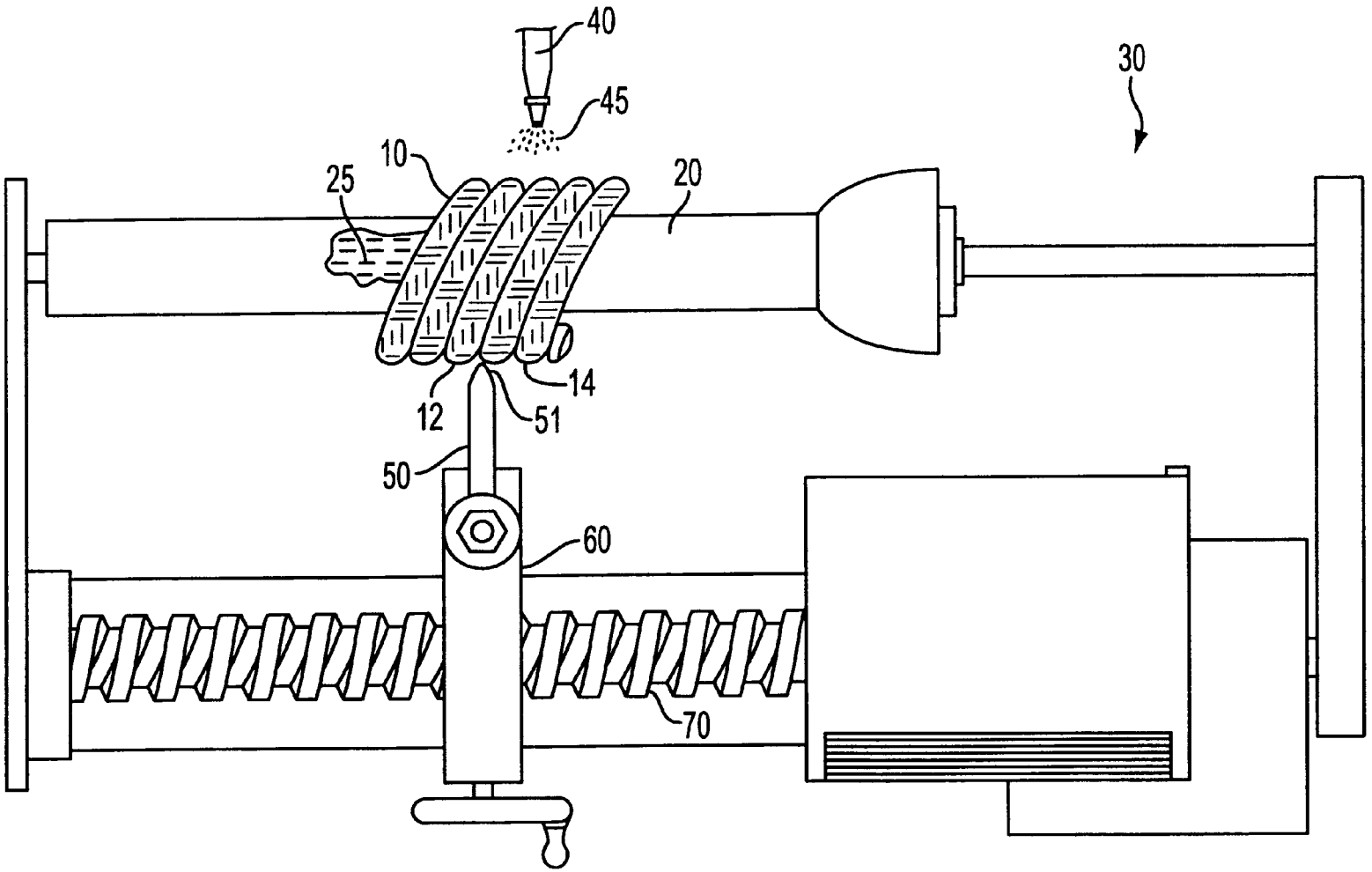
FIG. 1 is a schematic view of a hollow link chain arranged around a support or drum of a conventional ice lathe in preparation for deforming in accordance with the method of the present invention.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

Figure 1A:
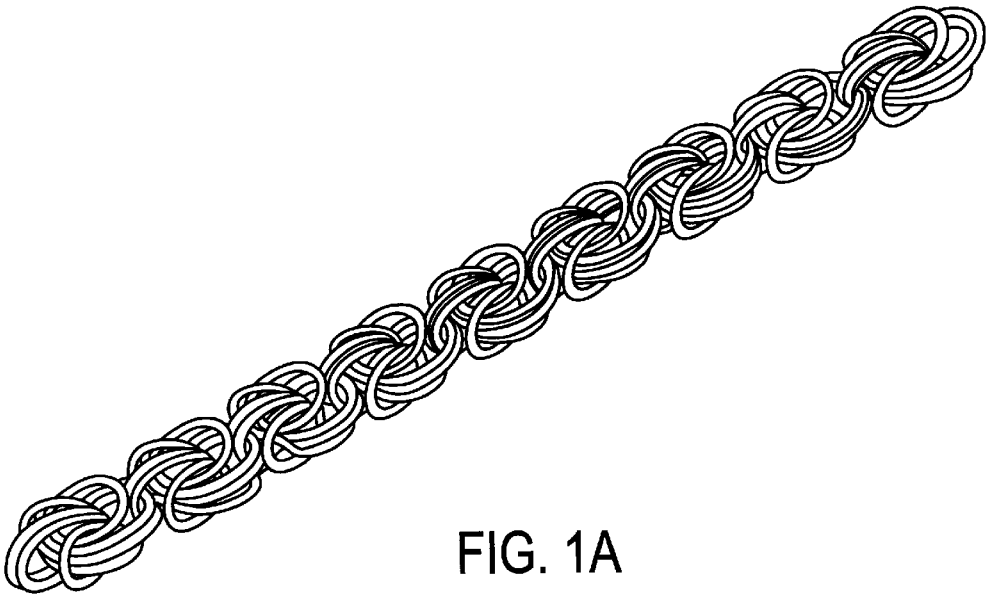
FIG. 1A is a perspective view of a hollow link jewelry chain capable of being deformed in accordance with the method of the present invention.
Figure 2:
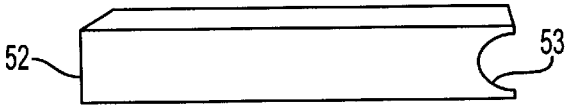
FIGS. 2 through 5 are alternate embodiments of the blunt instrument used to deform a hollow link chain in accordance with the method of the present invention.
Figure 3:
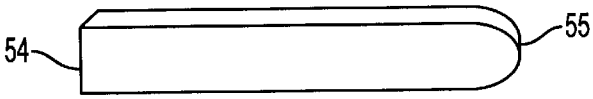
Figure 4:
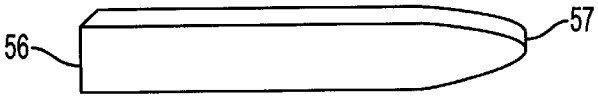
Figure 5:
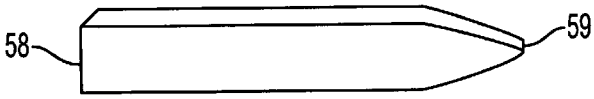

FIG. 1 is a schematic view of a hollow link jewelry chain 10 arranged around a support or drum 20 of a conventional ice lathe 30 in preparation for deforming in accordance with the method of the present invention. The chain 10 is formed from intertwined hollow links shown for purposes of example by links 12 and 14. The chain 10 is illustrated in FIG. 1 as a hollow link jewelry rope chain, although it will be understood that the method of the invention can be practiced with any type of hollow link jewelry chain such as, for example, the chain illustrated in FIG. 1A or others. The drum 20 is normally filled with a freezing medium 22, such as glycol, which reduces the temperature of both the drum 20 and the chain 10 arranged thereon, such that when a water source 40 is introduced to apply a spray of water 45 onto said chain 10, said water 45 freezes instantly to said chain 10 forming an ice layer thereon. The ice lathe 30 further comprises a blunt instrument 50 having an engaging end 51 that is attached to a support member 60, which support member is movable along a track 70. The blunt instrument 50 may be a so-called "finger of steel," which brushes across the surface of the chain 10 to flatten the links 12,14 for example. FIGS. 2–5 illustrate four alternative embodiments of a blunt instrument 52,54,56,58 having an arcuate engaging end 53, a rounded engaging end 55, a somewhat pointier engaging end 57 and a slightly pointy engaging end 59 respectively.

Figure 6:
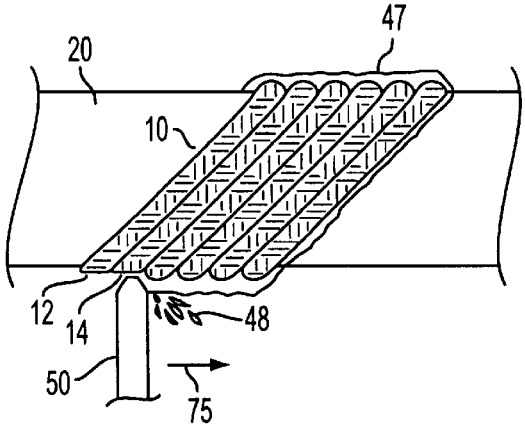
FIG. 6 is a close-up view showing the blunt instrument of the invention simultaneously scraping away a layer of ice and flattening the links of a hollow link chain arranged on an ice lathe drum.

To illustrate the method of diamond cutting hollow link jewelry chain in accordance with the present invention, a chain 10 is arranged around a cooled ice lathe drum 20 as shown in FIG. 6. The chain 10 has been sprayed with an icing agent 45 so that a layer of ice 47 surrounds the chain 10. A blunt instrument 50 is advanced in the direction of arrow 75 across the outer surface of the chain 10, which simultaneously scrapes off the ice, as shown by flying ice fragments 48, crushes the ice that has formed on the inside of the hollow links and deforms or flattens the surface of the chain, as shown by deformed or flattened links 12,14. The links of the chain 10 that remain under a layer of ice 47 remain rounded as shown in FIG. 6 until deformed as desired by the movement of the blunt instrument 50 thereacross. The blunt instrument 50 shown partially in FIG. 6 can have a variety of engaging end embodiments as shown in FIGS. 2–5, or alternative configurations may be used.

Figure 7:
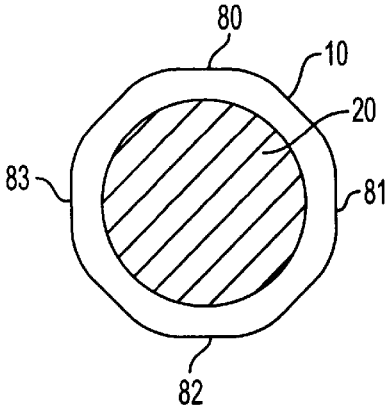
FIGS. 7 and 8 are cross-sectional views of a chain arranged on a drum showing four and eight facets arranged around the chain.
Figure 8:
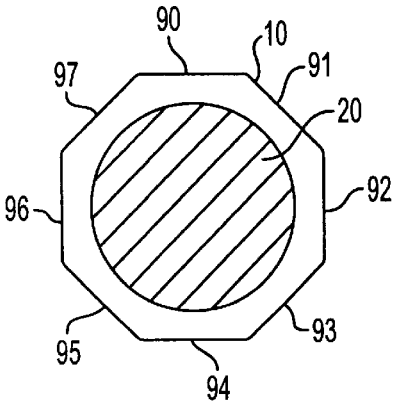
Figure 9:
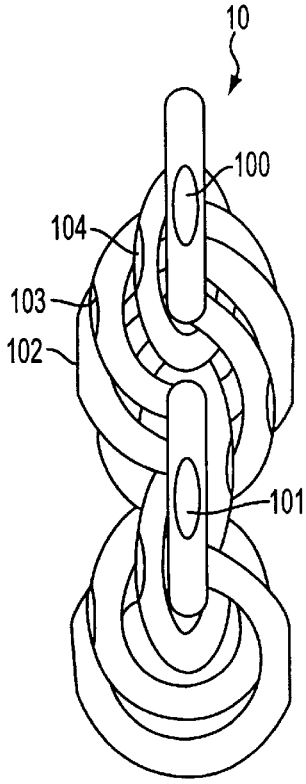
FIG. 9 shows a portion of a chain that has been spirally faceted in accordance with the method of the present invention.

Once a hollow link chain 10 is wound and frozen using the ice lathe method described above, the type of facets that can be made depend upon the ones that are desired. For example, as the drum rotates with the chain secured in place on the drum and the blunt instrument 50 is moved horizontally, the result will be a flat facet along one side of the chain 10, and the chain can then be rotated and repositioned in 90 degree increments to get four flat facets 80–83 on four sides of the chain 10 as shown in the cross-sectional view of FIG. 7, which illustrates a diagrammatic chain 10 arranged around an ice lathe drum 20. An alternative cross-sectional view of FIG. 8, which illustrates a diagrammatic chain 10 arranged around a support 20, shows eight facets 90–97 around eight sides of the chain 10, achieved by repositioning the chain in 45-degree increments after each faceting stroke by the blunt instrument. Alternately, any number of predetermined sides may be faceted either completely or partially depending on the desires of the user. On the other hand, if an arcuate blunt instrument is used, as in FIG. 2, as the blunt instrument moves along it, a spiral type faceted chain as shown in FIG. 9 can be made, with representative facets 100–104 spirally located on the links as shown. Once the chain is deformed or flattened as desired, the chain is thawed and removed from the drum.

It has been realized that a highly polished, faceted look is produced along the links of a hollow chain by using the deforming method of the present invention. Normally, diamond cut chains must be polished after they have been faceted in order to achieve a shiny, aesthetically appealing look. However, by deforming a hollow link chain in accordance with the method of the present invention, the inventor has discovered that a high quality polish is created upon flattening, and post-deformation polishing is no longer necessary, thereby further reducing manufacturing costs and increasing production time. Of course, however, such polishing can nevertheless be used. Thus, the diamond cutting method of the present invention saves manufacturing time and cost by avoiding the necessity of defrosting part of the chain prior to faceting, and by avoiding the necessity of polishing the chain after the chain has been faceted.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A method of imparting facets to an elongated jewelry chain formed from intertwined hollow chain links comprising:

a) arranging said chain on a supporting drum of an ice lathe, b) freezing said chain so that said chain is completely frozen in ice, c) deforming a portion of said links of said chain by moving a blunt instrument continuously and longitudinally across a surface of said links, d) thawing said chain, and e) removing said chain from said drum.

2. A method of imparting facets in accordance with claim 1, wherein said deforming results in the simultaneous scraping of ice from said portion of said links and the flattening of said links by said blunt instrument.

3. A method of imparting facets in accordance with claim 1, wherein said chain is kept still during the deforming of said portion of said links.

4. A method of imparting facets in accordance with claim 1, wherein said deforming results in the crushing of ice that has formed on the inside of said chain links.

5. A method of imparting facets in accordance with claim 1, wherein said deforming occurs a predetermined number of times to create a predetermined number of facets along said chain.

6. A method of imparting facets in accordance with claim 5, wherein said chain is repositioned 90 degrees prior to each deforming step so that said chain has four facets on four sides of said chain.

7. A method of imparting facets in accordance with claim 1, wherein said blunt instrument is a finger of steel.

8. A method of imparting facets in accordance with claim 1, wherein said blunt instrument is slightly pointy.

9. A method of imparting facets in accordance with claim 1, wherein said blunt instrument has an arcuate end.

10. A method of imparting facets to an exterior surface of an elongated jewelry chain, said chain formed from intertwined hollow chain links comprising the steps of:

a) arranging said chain on a support, b) freezing said chain so that said exterior of said chain is completely frozen, c) deforming said exterior of said chain by moving a blunt instrument continuously and longitudinally across a surface of said chain, d) thawing said chain, and e) removing said chain from said support.

11. A method of imparting facets in accordance with claim 10, wherein said chain is frozen in ice prior to deforming.

12. A method of imparting facets in accordance with claim 11, wherein said deforming is preceded by the scraping of ice from said exterior surface of said chain by said blunt instrument.

13. A method of imparting facets in accordance with claim 10, wherein said chain is kept stationary during deforming.

14. A method of imparting facets in accordance with claim 11, wherein said deforming results in the crushing of ice that has formed on the inside of said chain links.

15. A method of imparting facets in accordance with claim 10, wherein said deforming occurs a predetermined number of times to create a predetermined number of facets along said exterior surface.

16. A method of imparting facets in accordance with claim 15, wherein said chain is repositioned 90 degrees prior to each deforming step so that said chain has four facets on four sides of said chain.

17. A method of imparting facets in accordance with claim 10, wherein said blunt instrument is a finger of steel.

18. A method of imparting facets in accordance with claim 10, wherein said blunt instrument is slightly pointy.

19. A method of imparting facets in accordance with claim 10, wherein said blunt instrument has an arcuate end.

20. A method of imparting facets in accordance with claim 10, wherein said chain is a rope chain.

* * * * *